United States Patent [19]

Hösel

[11] Patent Number: 4,977,645

[45] Date of Patent: Dec. 18, 1990

[54] APPARATUS FOR REMOVING FOREIGN METAL BODIES FROM A FIBER TRANSPORTING DUCT

[75] Inventor: Fritz Hösel, Monchen-Gladbach, Fed. Rep. of Germany

[73] Assignee: Trützschler GmbH & Co. KG, Monchen-Gladbach, Fed. Rep. of Germany

[21] Appl. No.: 383,637

[22] Filed: Jul. 24, 1989

[30] Foreign Application Priority Data

Jul. 23, 1988 [DE] Fed. Rep. of Germany ..... 3825109

[51] Int. Cl.[5] ..... D01B 3/00

[52] U.S. Cl. ..... 19/200; 19/205; 19/80 R

[58] Field of Search ..... 19/200, 204, 205; 209/555, 570

[56] References Cited

U.S. PATENT DOCUMENTS

| | | | |
|---|---|---|---|
| 2,163,242 | 6/1939 | Kagan | 19/72 |
| 4,171,262 | 10/1979 | Lattmann et al. | 209/555 |
| 4,480,753 | 11/1984 | Thomas et al. | 209/546 |
| 4,498,215 | 2/1985 | Hergeth et al. | 19/81 |
| 4,707,887 | 11/1987 | Leifeld et al. | 19/0.2 |
| 4,753,353 | 6/1988 | Kramer | 209/570 |
| 4,763,792 | 8/1988 | Kind | 209/570 |
| 4,805,266 | 2/1989 | Leifeld et al. | 19/0.2 |

FOREIGN PATENT DOCUMENTS

| | | |
|---|---|---|
| 143231 | 6/1985 | European Pat. Off. . |
| 202356 | 11/1986 | European Pat. Off. . |
| 3323162 | 1/1985 | Fed. Rep. of Germany . |
| 3533390 | 3/1987 | Fed. Rep. of Germany . |
| 3152418 | 6/1988 | Japan . |
| 2200374 | 12/1987 | United Kingdom . |

*Primary Examiner*—Werner H. Schroeder
*Assistant Examiner*—Michael A. Neas
*Attorney, Agent, or Firm*—Spencer & Frank

[57] ABSTRACT

A system for removing foreign metal bodies from a pneumatically conveyed stream of fiber material includes a fiber conveying duct in which the fiber material is pneumatically advanced; a branch-off location in the duct; a branch conduit joining the duct at the branch-off location; a metal detector for ascertaining the presence of a foreign metal body in the stream of fiber material at a sensing location upstream of the branch-off location; a channelling device arranged in the branch-off location for selectively directing the fiber stream into the branch conduit or, respectively, causing the fiber stream to continue travel in the duct past the branch-off location; a control device operatively connected to the metal detector and the channelling device for moving the channelling device into a removal position upon ascertaining the passage of a foreign metal body by the detector; and at least one bend in the duct for changing the direction of travel of fiber material in the duct. The bend is situated between the branch-off location and the sensing location.

20 Claims, 3 Drawing Sheets

FIG.1
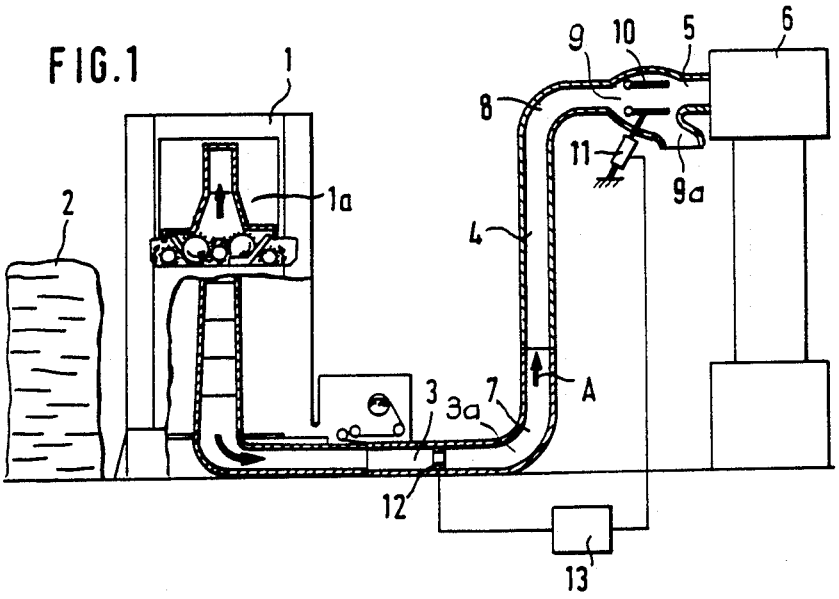
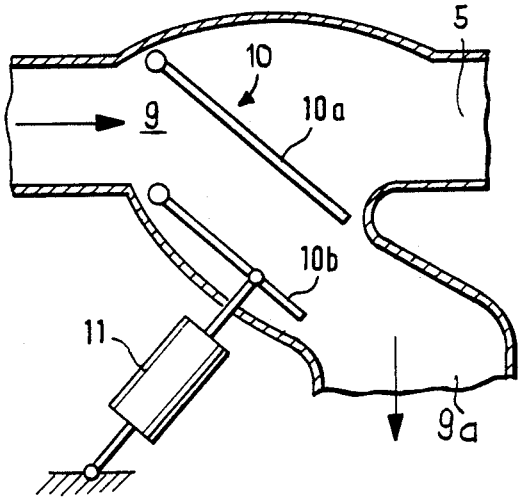
FIG.1a

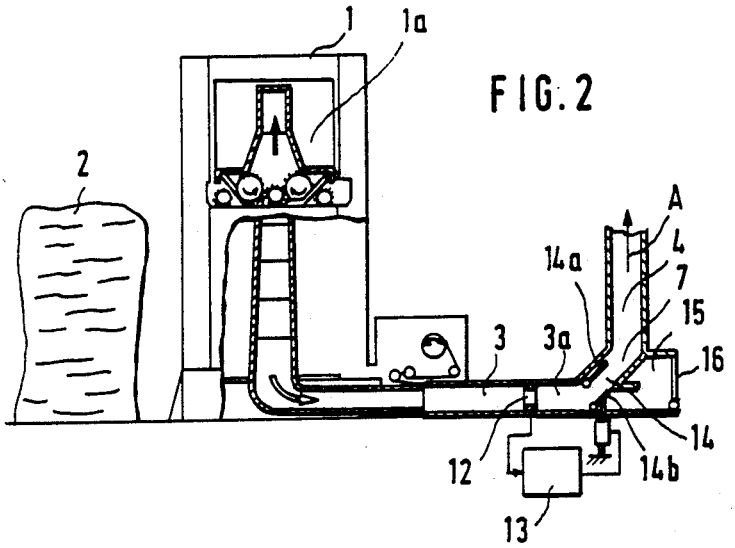
FIG. 2
FIG. 2a
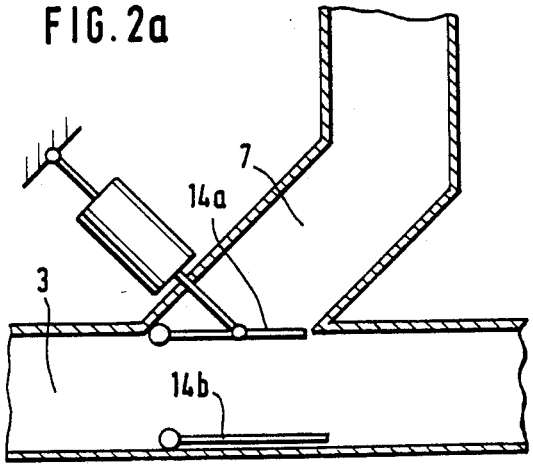

APPARATUS FOR REMOVING FOREIGN METAL BODIES FROM A FIBER TRANSPORTING DUCT

CROSS REFERENCE TO RELATED APPLICATION

This application claims the priority of Federal Republic of Germany Application No. P 38 25 109.4 filed July 23rd, 1988, which is incorporated herein by reference.

BACKGROUND OF THE INVENTION

This invention relates to an apparatus for removing foreign metal bodies from a travelling fiber mass which is advanced pneumatically in a conveyor duct in a spinning preparation plant. The duct has a branch-off location accommodating a deflector (channelling) mechanism for the foreign bodies and, upstream of the branch-off location—as viewed in the direction of fiber conveyance—a metal detector is arranged which is operatively coupled to the deflector mechanism in such a manner that the latter is moved into its deflecting (foreign body removing) position when a foreign metal body passes by the detector and is sensed thereby.

In a known apparatus of the above-outlined type there is provided a horizontal fiber conveying duct between two serially arranged fiber processing machines and the branch-off location as well as the metal detector are associated with the duct. The distance between the metal detector and the branch-off location of the duct is so designed that the time necessary for conveying the fiber tufts from the zone of the metal detector to the branch-off location is greater than the switching time needed for the deflecting mechanism. Because of the required reaction time, delay tracks between the metal detector and the deflecting mechanism (such as a guide baffle) are needed. The relatively long horizontal duct characterizing the prior ar constructions is disadvantageous where two consecutive fiber processing machines have to be arranged at a short distance from one another. It is a further disadvantage of the prior art constructions that a certain standard reaction time is present between the sensing of the foreign body and the switching of the guide baffle resulting, occasionally, in an excessive removal of fiber material together with the foreign body.

SUMMARY OF THE INVENTION

It is an object of the invention to provide an improved apparatus of the above-outlined type from which the discussed disadvantages are eliminated and which, in particular, ensures the detection and removal of foreign bodies, particularly of metal, from a conveyor duct connecting two machines that are situated at a short distance from one another.

This object and others to become apparent as the specification progresses, are accomplished by the invention, according to which, briefly stated, between the branch-off location and the metal detector the duct changes direction at least once.

It is an advantage of the invention which provides at least one bend (change of direction) in the duct between the metal detector and the branch-off location, that significant space may be saved.

The invention has the following additional advantageous features:

The change of direction is between 45 and 135°;

The metal detector is associated with the fiber tuft removal channel (suction channel) of a bale opener so that, as a result, the consecutive, downstream-arranged machine may be arranged at a short distance from the removal channel;

Immediately upstream of the branch-off location of the fiber conveying duct an upwardly oriented duct portion is arranged and between the branch-off location and the rising duct portion a bend is provided in the duct. By virtue of the substantially vertically rising duct portion the distance between two serially arranged fiber processing machines—interconnected by the fiber duct—is reduced;

The metal detector is arranged at the upstream end of the vertical duct portion, and the branch-off location is situated downstream of the bend so that the fiber tufts may, together with the foreign body, drop by gravity;

A bend (change of direction) in the fiber conveying duct is provided between the rising duct portion and the suction channel of the bale opener, and the metal detector is situated in the suction channel upstream of the bend;

A switchable baffle (channelling device) is arranged at the downstream end of the suction channel of the bale opener such that upon actuation of the baffle the fiber material containing the foreign body may be removed from the fiber stream without change of direction. Thus, the baffle is maintained in its straight position until the fiber tufts, together with the metal body are removed. The baffle is arranged in the fiber conveying duct provided with the bend (change of direction);

A sensor responding to air speed and/or air pressure in the fiber conveying duct is provided and is electrically connected with the baffle control device. This arrangement prevents an excessive amount of fiber material from being removed together with the foreign metal body. The reaction time that elapses between sensing the presence of a metal body and the setting of the movable channelling baffle is adapted to the air speed or air pressure. In this manner it is ensured that with the foreign metal body only the smallest necessary amount of fiber is separated from the fiber stream.

Expediently, an inputting device is provided for manually inputting data to the control apparatus which may include a microcomputer.

BRIEF DESCRIPTION OF THE DRAWING

FIG. 1 is a schematic side elevational view of a bale opener and a fiber processing machine, connected by a fiber conveying duct incorporating a preferred embodiment of the invention.

FIG. 1*a* is an enlarged schematic side elevational view of a component of the preferred embodiment shown in a foreign body removal position.

FIG. 2 is a schematic side elevational view of a bale opener including a suction channel leading therefrom and incorporating another preferred embodiment of the invention.

FIG. 2*a* is an enlarged schematic side elevational view of a component of the embodiment of FIG. 2, illustrated in a foreign body removal position.

DESCRIPTION OF THE PREFERRED EMBODIMENTS

Figure 3A:
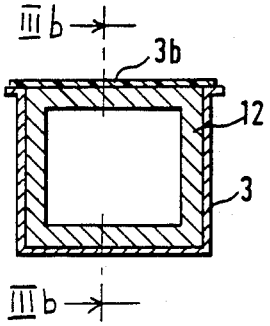
FIG. 3*a* is an enlarged sectional end elevational view of a component of the invention.

Turning to FIG. 1, there is illustrated therein a bale opener 1 which may be a BLENDOMAT BDT model manufactured by Trützschler GmbH & Co. KG, Mönchengladbach, Federal Republic of Germany. The bale opener has a detaching device 1*a* which, by means of rapidly rotating toothed rollers tears fiber tufts from the top of the fiber bales 2 (only one shown) as the bale opener 1 travels therealong. As will be described in more detail below, the fiber tufts are pneumatically delivered in conveyor ducts to fiber processing machines, such as designated at 6. The fiber tuft stream may contain foreign metal bodies such as metal strap fragments, nails, etc. which are likely to cause malfunctions in the fiber processing machines and should therefore be removed from the fiber stream to prevent their admission into the processing machines.

The fiber tufts, after their detachment from the fiber bales, are pneumatically driven through a horizontally arranged suction channel 3 which continues in fiber conveying ducts 4 and 5 leading to the fiber processing machine 6. Between the suction channel 3 and the vertically rising conveyor duct 4 there is provided an elbow or bend 7 and similarly, between the downstream end of the conveyor duct 4 and the upstream end of a horizontal conveyor duct 5 an elbow or bend 8 is provided. The elbows 7 and 8 cause a change in the direction of the fiber flow.

In the duct 5 there is provided a branch-off location 9 where a channelling device formed as a pivotal baffle 10 is situated. A branch conduit 9*a* extends from the duct 5 at the branch-off location 9. A setting device 11 is coupled to the baffle 10. Upstream of the branch-off location 9, as viewed in the direction A of material flow, in the fiber tuft duct a metal detector 12 such as an inductive coil is arranged. The channelling device 10 and its setting member 11—which may comprise a pneumatic power cylinder—are operatively connected to an output of a control device 13, while the metal detector 12 is connected to an input thereof. As illustrated in FIG. 1*a*, the channelling device 10 is formed of two pivotally supported parallel baffles 10*a* and 10*b* which are moved in unison (by virtue of a connecting linkage, not shown) by the setting member 11.

During normal operating conditions, that is, when no foreign metal object is sensed by the detector 12, the channelling device 10 is oriented such that the fiber tuft stream is directed into the fiber processing machine 6.

If the detector 12 senses the passage of a metal object, a corresponding signal is sent to the control device 13 which, in turn, actuates the setting device 11, whereupon the latter moves the channelling device 10, from the position shown in FIG. 1, into alignment with the branch conduit 9*a*, as shown in FIG. 1*a* to thus deflect the fiber tuft stream, together with the sensed metal body, to prevent the latter from entering the fiber processing machine 6.

By virtue of the 90° elbows 7 and 8 which are situated in the duct between the metal detector 12 and the branch-off location 9, the appropriate conduit length for the necessary reaction time between detection of the metal body and the switching of the channelling device 10 is ensured and by providing the rising (vertical) duct portion 4 a significant space saving is achieved, whereby the fiber processing machine 6 may be situated at a short distance from the outlet 3*a* of the suction duct 3 of the bale opener 1.

Turning now to the embodiment illustrated in FIGS. 2, 2*a*, the metal detector 12 is situated in the suction channel 3 of the bale opener 1, close to the channel outlet 3*a*. The detector 12 is connected with the intermediary of the control device 13 with a channelling device 14 which, similarly to the earlier-described embodiment, has two pivotally supported parallel baffles 14*a*, 14*b* which move in unison. Between the suction channel 3 and the vertical duct 4 there is provided an elbow 7 which is of linear course and which is thus angularly arranged between the horizontal outlet 3*a* and the vertical duct 4. The elbow 7 thus effects a 45° change in the flow direction of the fiber material as the latter leaves the outlet 3*a* of the suction duct 3 of the bale opener 1. As the detector 12 senses a metal body, the baffles 14*a*, 14*b* assume a position to provide a straight-line continuation of the flow direction of the material in the suction channel 3 until the fiber material, together with the foreign metal body are received by a collecting chamber 15 from which fiber material with the metal component may be removed through a gate 16.

Figure 3B:
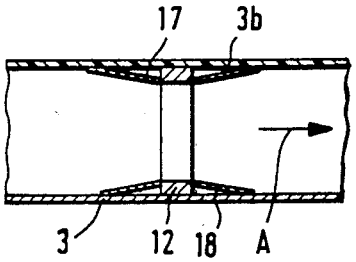
FIG. 3*b* is a schematic longitudinal sectional view taken along III*b*—III*b* of FIG. 3*a*.

As shown in FIG. 3*a*, the metal detector 12 is built into the suction channel 3 which is covered by a flexible cover belt 3*b*. As shown in FIG. 3*b*, upstream and downstream of the metal detector 12 there are provided oblique guide plates 17 and 18 which ensure the streamlined flow of the material despite the presence of the metal detector 12.

Figure 4:
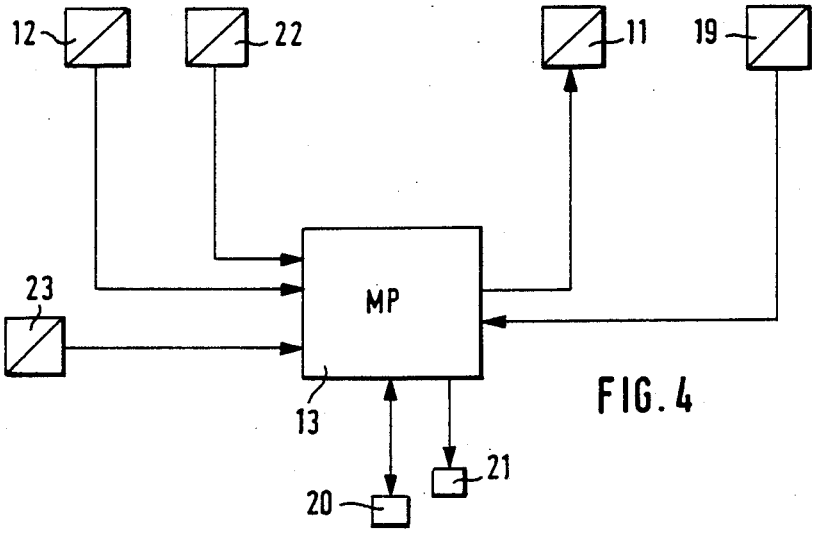
FIG. 4 is a block diagram of a control device of the invention.

Turning now to FIG. 4, to the control device 13 which may be a microcomputer with a microprocessor, there are connected the metal detector 12, the setting member 11, a device 19 for manual data input (such as the distance between the metal detector and the channelling device), a device 20 for communicating with the machine control of the bale opener 1, a device 21 for reporting the sensing of operational data, a sensor 22 for ascertaining air speed in the suction channel 3 or in the ducts 4 and 5, a sensor 23 (for example, an electronic pressure sensor) for ascertaining the air pressure in the suction channel 3 or in the fiber ducts 4, 5.

It will be understood that the above description of the present invention is susceptible to various modifications, changes and adaptations, and the same are intended to be comprehended within the meaning and range of equivalents of the appended claims.

What is claimed is:

1. In a system for removing foreign metal bodies from a pneumatically conveyed stream of fiber material, in combination with two serially arranged fiber processing machines; the system including a fiber conveying duct in which the fiber material is pneumatically advanced from one of the fiber processing machines to the other; a branch-off location in the duct;

a branch conduit joining said duct at said branch-off location and extending away from said duct;

a metal detector means for ascertaining the presence of a foreign metal body in the stream of fiber material at a sensing location upstream of said branch-off location as viewed in the direction of fiber advance in the duct;

channelling means arranged in said branch-off location and having a first and a second position for selectively directing the fiber stream into the branch conduit or, respectively, causing the fiber stream to continue travel in said duct past said branch-off location dependent on the position of the channelling means; and control means operatively connected to said metal detector means and said channelling means for moving said channelling means from said second position to said first position upon ascertaining the passage of a foreign metal body by said detector means;

the improvement comprising at the most two bends in said duct for changing the direction of travel of fiber material in said duct for allowing a shortening of distance between the two fiber processing machines; said bends being situated between said branch-off location and said sensing location.

2. A system as defined in claim 1, wherein the bends have an angle of between approximately 45° and 135°.

3. A system as defined in claim 1, wherein upstream of said branch-off location, as viewed in said direction, said duct has an ascending part; at least one of said bends being situated between said branch-off location and said ascending part.

4. A system as defined in claim 1, wherein downstream of said branch-off location, as viewed in said direction, said duct has an ascending part; said metal detector being situated upstream of said ascending part.

5. A system as defined in claim 1, wherein one of the fiber processing machines is a fiber bale opener having a suction channel for conveying fiber tufts detached from fiber bales by the bale opener; said suction channel having a downstream end, as viewed in said direction, connected to said duct; said metal detector means being disposed in said suction channel.

6. A system as defined in claim 1, wherein said branch conduit is a straight-line continuation of a length portion of said duct.

7. A system as defined in claim 1, further comprising an air speed sensor disposed in said duct and connected with said control means.

8. A system as defined in claim 1, further comprising an air pressure sensor disposed in said duct and connected with said control means.

9. A system as defined in claim 1, further comprising an inputting device connected to said control means for manually applying data thereto.

10. A system as defined in claim 9, wherein said control means comprises a microcomputer.

11. A system as defined in claim 1, wherein said channelling means comprises a baffle pivotally supported in said duct.

12. A system as defined in claim 11, wherein said baffle comprises two spaced, parallel baffle plates movable in unison.

13. A system as defined in claim 1, wherein one of the fiber processing machines is a fiber bale opener having a suction channel for conveying fiber tufts detached from fiber bales by the bale opener; said suction channel having a downstream end, as viewed in said direction, connected to said duct; said duct including an ascending part; at least one of said bends being situated between said downstream end of said suction channel and said ascending part.

14. A system as defined in claim 13, further comprising an air speed sensor disposed in said suction channel and connected with said control means.

15. A system as defined in claim 13, further comprising an air pressure sensor disposed in said suction channel and connected with said control means.

16. In a system for removing foreign metal bodies from a pneumatically conveyed stream of fiber material, including a fiber conveying duct in which the fiber material is pneumatically advanced; a branch-off location in the duct;

a branch conduit joining said duct at said branch-off location and extending away from said duct;

a metal detector means for ascertaining the presence of a foreign metal body in the stream of fiber material at a sensing location upstream of said branch-off location as viewed in the direction of fiber advance in the duct;

channelling means arranged in said branch-off location and having a first and a second position for selectively directing the fiber stream into the branch conduit or, respectively, causing the fiber stream to continue travel in said duct past said branch-off location dependent on the position of the channelling means; and control means operatively connected to said metal detector means and said channelling means for moving said channelling means from said second position to said first position upon ascertaining the passage of a foreign metal body by said detector means;

the improvement comprising (a) at least one bend in said duct for changing the direction of travel of fiber material in said duct; said bend being situated between said branch-off location and said sensing location; and (b) an air speed sensor disposed in said duct and connected with said control means.

17. In a system for removing foreign metal bodies from a pneumatically conveyed stream of fiber material, including a fiber conveying duct in which the fiber material is pneumatically advanced; a branch-off location in the duct;

a branch conduit joining said duct at said branch-off location and extending away from said duct;

a metal detector means for ascertaining the presence of a foreign metal body in the stream of fiber material at a sensing location upstream of said branch-off location as viewed in the direction of fiber advance in the duct;

channelling means arranged in said branch-off location and having a first and a second position for selectively directing the fiber stream into the branch conduit or, respectively, causing the fiber stream to continue travel in said duct past said branch-off location dependent on the position of the channelling means; and control means operatively connected to said metal detector means and said channelling means for moving said channelling means from said second position to said first position upon ascertaining the passage of a foreign metal body by said detector means;

the improvement comprising (a) at least one bend in said duct for changing the direction of travel of fiber material in said duct; said bend being situated between said branch-off location and said sensing location; and (b) an air pressure sensor disposed in said duct and connected with said control means.

18. In a system in combination with a fiber bale opener for removing foreign metal bodies from a pneumatically conveyed stream of fiber material, including a fiber conveying duct in which the fiber material is pneumatically advanced; a branch-off location in the duct; said duct including an ascending part;

a branch conduit joining said duct at said branch-off location and extending away from said duct;

a metal detector means for ascertaining the presence of a foreign metal body in the stream of fiber material at a sensing location upstream of said branch-off location as viewed in the direction of fiber advance in the duct;

channelling means arranged in said branch-off location and having a first and a second position for selectively directing the fiber stream into the branch conduit or, respectively, causing the fiber stream to continue travel in said duct past said branch-off location dependent on the position of the channelling means; and control means operatively connected to said metal detector means and said channelling means for moving said channelling means from said second position to said first position upon ascertaining the passage of a foreign metal body by said detector means;

said fiber bale opener having a suction channel for conveying fiber tufts detached from fiber bales by the bale opener; said suction channel having a downstream end, as viewed in said direction, connected to said duct;

the improvement comprising (a) at least one bend in said duct for changing the direction of travel of fiber material in said duct; said bend being situated between said downstream end of said suction channel and said ascending part; and (b) an air speed sensor disposed in said suction channel and connected with said control means.

19. In a system in combination with a fiber bale opener for removing foreign metal bodies from a pneumatically conveyed stream of fiber material, including a fiber conveying duct in which the fiber material is pneumatically advanced; a branch-off location in the duct; said duct including an ascending part;

a branch conduit joining said duct at said branch-off location and extending away from said duct;

a metal detector means for ascertaining the presence of a foreign metal body in the stream of fiber material at a sensing location upstream of said branch-off location as viewed in the direction of fiber advance in the duct;

channelling means arranged in said branch-off location and having a first and a second position for selectively directing the fiber stream into the branch conduit or, respectively, causing the fiber stream to continue travel in said duct past said branch-off location dependent on the position of the channelling means; and control means operatively connected to said metal detector means and said channelling means for moving said channelling means from said second position to said first position upon ascertaining the passage of a foreign metal body by said detector means;

said fiber bale opener having a suction channel for conveying fiber tufts detached from fiber bales by the bale opener; said suction channel having a downstream end, as viewed in said direction, connected to said duct;

the improvement comprising (a) at least one bend in said duct for changing the direction of travel of fiber material in said duct; said bend being situated between said downstream end of said suction channel and said ascending part; and (b) an air pressure sensor disposed in said suction channel and connected with said control means.

20. A system as defined in claim 1, wherein the number of said at most two bends is two.

* * * * *